United States Patent [19]

Kreuter et al.

[11] Patent Number: 4,794,847

[45] Date of Patent: Jan. 3, 1989

[54] ROTARY ACTUATOR

[75] Inventors: Paul E. Kreuter; Larry G. Odegaard, both of Thief River Falls, Minn.

[73] Assignee: Kreuter Mfg. Co., Inc., New Paris, Ind.

[21] Appl. No.: 126,621

[22] Filed: Nov. 30, 1986

[51] Int. Cl.[4] ..... F01B 9/00

[52] U.S. Cl. ..... 92/136; 92/116; 92/137; 92/98 D; 92/98 R; 403/225; 251/58; 251/60; 248/667; 248/664; 74/109; 74/411

[58] Field of Search ..... 92/98, 13.1, 13.2, 13.6, 92/31, 32, 33, 116, 136, 137, 129; 98/121.2, 110, 121.1; 403/225, 227, 220; 251/58, 60, 61; 248/667, 664, 675; 74/109, 411, 470

[56] References Cited

U.S. PATENT DOCUMENTS

| | | | |
|---|---|---|---|
| 2,728,593 | 12/1955 | Hutton | 403/225 |
| 2,978,116 | 4/1961 | Wells et al. | 248/664 |
| 3,146,594 | 9/1964 | Allen | 251/58 |
| 3,175,110 | 3/1965 | Kohlhagen | 74/411 |
| 3,985,151 | 10/1976 | Smith | 251/58 |
| 4,158,511 | 6/1979 | Herbenar | 403/225 |

FOREIGN PATENT DOCUMENTS

| | | | |
|---|---|---|---|
| 0576677 | 4/1933 | Fed. Rep. of Germany | 92/136 |
| 2160022 | 6/1973 | Fed. Rep. of Germany | 403/225 |
| 2627599 | 12/1977 | Fed. Rep. of Germany | 92/136 |
| 552523 | 5/1923 | France | 92/136 |
| 0047060 | 4/1979 | Japan | 248/667 |
| 120582 | 1/1948 | Sweden | 248/664 |

*Primary Examiner*—Robert E. Garrett
*Assistant Examiner*—Thomas Denion
*Attorney, Agent, or Firm*—Kinney & Lange

[57] ABSTRACT

A rotary actuator for a damper shaft controls the angular position of the damper shaft in accordance with variations in fluid pressure inside of the actuator. The actuator includes a housing, a flexible diaphragm within the housing separating it into a fluid-tight compartment and a second compartment open to the atmosphere. The fluid-tight compartment is provided with a fluid pressure receving port open to a control source of variable pressure. The piston and piston rod are slidably mounted in the second compartment in contact with the diaphragm. The piston rod includes a longitudinally extending rack, and a crank arm rotatably mounted in the housing has a gear segment in meshing relationship with the rack. The actuator shaft to be controlled extends through the housing and is mounted in the crank arm to support the rotary actuator, and the rotary actuator is clipped to an air conditioning duct to prevent it from rotating on the damper actuator shaft axis.

9 Claims, 2 Drawing Sheets

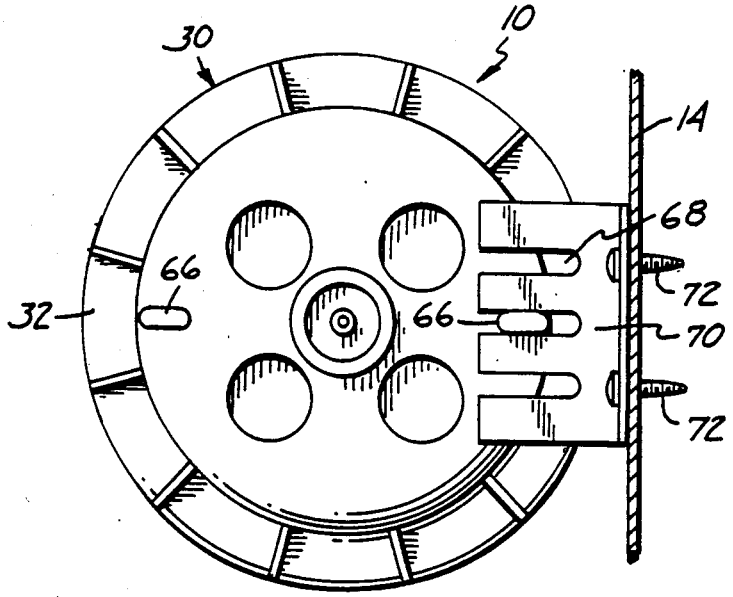
Fig. 3
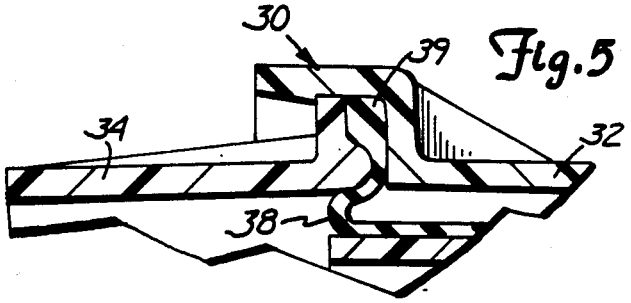
Fig. 5
Fig. 4
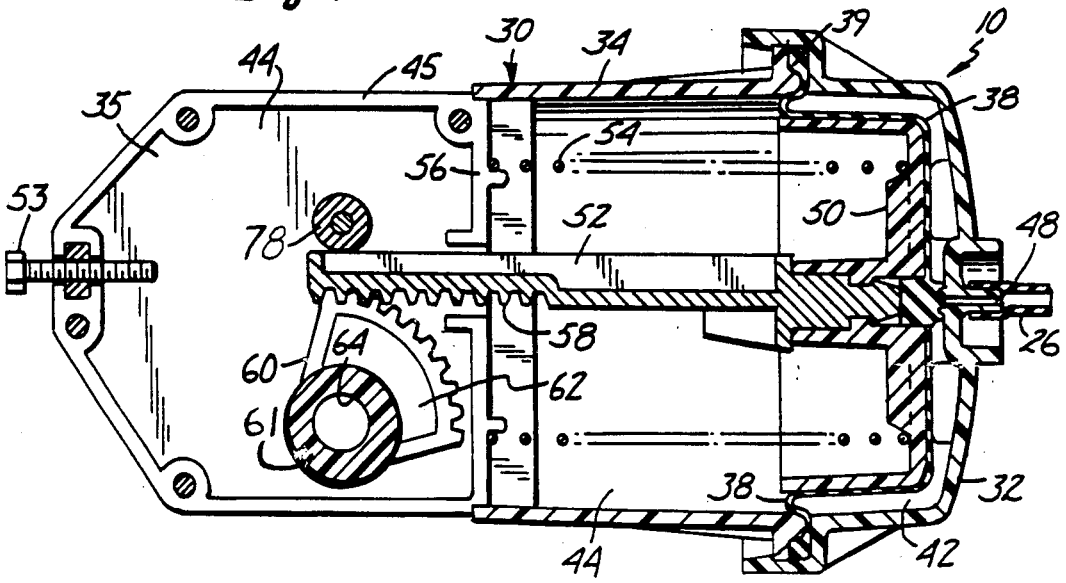

ROTARY ACTUATOR

BACKGROUND OF THE INVENTION

1. Field of the Invention.

This invention has relation to a rotary actuator of a type serving as a transducer for controlling the angular position of a damper actuator shaft as a function of variations in fluid pressure within the actuator.

2. Description of the Prior Art.

Damper actuators which serve as linear motors to control the straight line linear positioning of actuator shafts as a function of variations in fluid pressure within the actuator are well known. Such actuators have been sold by Kreuter Manufacturing Company as their Model MCP-1040 and Model MCP-1140 Damper Actuators. To properly install such actuators, however, in such a manner as to use the linear movement of the shaft to control the angular position of a damper shaft rotatably mounted and extending outwardly from an air duct, for example, is labor intensive and time consuming. A special angle bracket must be fastened to the damper actuator and the angle bracket then carefully mounted to the duct wall in fixed relationship to the damper shaft. Next a crank arm had to be loosely installed on the damper shaft before the angle bracket was firmly fixed in position. A number of very carefully positioned sheet metal screws were then used to attach the bracket to the duct work, the crank arm was lined up with the linear damper actuator shaft, the position of the damper blade checked. Only then the crank arm set screws were tightened on the damper shaft. Installations not carefully made resulted in wear on misaligned parts and eventual failure. Any shifting of the actuator mechanisms with respect to the damper, damper shaft and/or duct wall over time can also result in wear and eventual failure.

Other variations of mechanims to convert the linear motion of an actuator shaft to rotary motion of a damper shaft have also included the use of a crank arm mounted on the damper shaft and in some manner or other to the linearly moving actuator shaft. All have required very careful installation, and, over the months and years of operation, many have experienced wear and breakdown of parts due to misalignment of the damper shaft, the crank arm, and the linearly moving actuator shaft.

What was needed before the present invention was a rotary actuator which could be mounted directly with respect to the damper shaft, for example, to reduce very substantially the time needed for installation; and to eliminate forever the possiblity of misalignment of the parts with respect to the damper and the damper shaft.

SUMMARY OF THE INVENTION

A rotary actuator made according to the present invention is for controlling the angular position of a shaft rotatably mounted with respect to a base as a function of variations in fluid pressure within the actuator.

The actuator includes a housing anchored against movement with respect to a base, such, for example, as the wall of a duct or other air handling conduit in an air conditioning system. A diaphragm within the housing separates the housing into a fluid-tight first compartment and a second compartment open to the atmosphere or other ambient pressure. A piston and a piston rod are slidably mounted within the second open compartment with the piston being in operative contact with the diaphragm. The housing is provided with a fluid pressure receiving port open to the fluid-tight first compartment from a control source of variable pressure.

The diaphragm, piston and piston rod are movable between a first position wherein the fluid-tight first compartment of the housing has a minimum volume and a second position wherein said first compartment has a maximum volume.

Bias means is operative within the housing to tend to move the diaphragm, piston and rod toward their first positions against the action of the fluid pressure in the first compartment tending to move these parts toward their second positions. In the form of the invention as shown, this bias means is a compression coil spring mounted within the second compartment of the housing and operative to tend to move the piston toward the first compartment.

The piston rod includes a longitudinally extending rack. A crank arm in the form of a gear segment is rotatably mounted within the second compartment of the housing in operative, meshing engagement with the piston rod rack. The housing and the gear segment are provided with openings to receive a shaft to be controlled.

In the form of the invention as shown, for example, this shaft is a damper shaft rotatably mounted with respect to a base such as a duct wall. The damper shaft extends integrally from a damper used to control the air flow in an air conditioning duct. The rotary actuator is installed on the damper shaft by passing the shaft through the openings in the housing and the gear segment. The damper shaft now becomes the actuator shaft. Means is provided to key this damper/actuator shaft to rotate with the gear segment.

By enclosing and mounting the piston rod and gear segment entirely within the actuator housing, and by supporting the actuator of the invention directly on the shaft to be controlled, all possibility of undue friction between these parts developing at the time of installation or thereafter is forever eliminated. It is only necessary to then utilize a simple clip to pin one end of the rotary actuator with respect to the base to prevent movement of the rotary actuator around the axis of the shaft to be controlled.

BRIEF DESCRIPTION OF THE DRAWINGS

FIG. 3 is an end view of the actuator of FIGS. 1 and 2 together with the duct wall and mounting clip as seen from the right in FIG. 2;

FIG. 4 is a vertical sectional view taken on the lne 4—4 in FIG. 2; and

FIG. 5 is a fragmentary sectional view of part of the actuator showing the details of construction of two portions of the actuator housing and of the fluid tight mounting of a diaphragm with respect thereto.

DETAILED DESCRIPTION OF THE PREFERRED EMBODIMENTS

Figure 1:
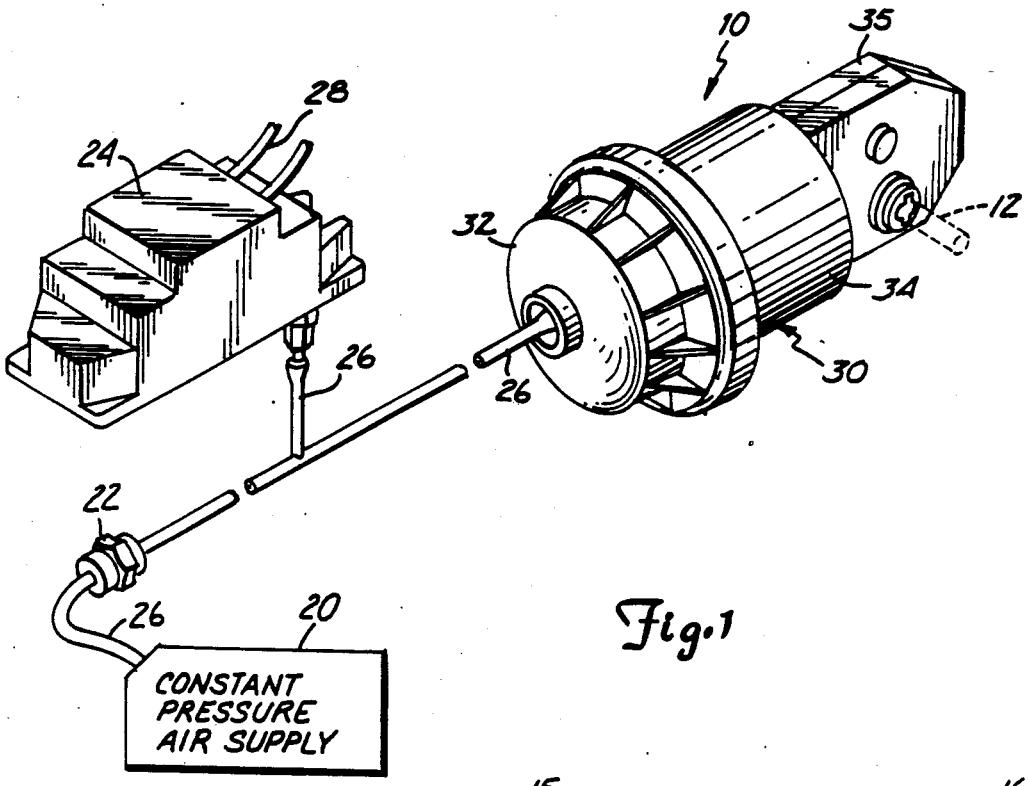
FIG. 1 is a perspective view of a rotary actuator made according to the present invention shown in association with means for varying the pressure of air reaching the actuator as a function of an electrical control signal received by such means.

A rotary actuator 10 serves as a fluid pressure activated work device for controlling the angular position of a damper/actuator shaft 12 with respect to a base or duct wall 14. The damper shaft controls the positioning of an integral damper blade or damper 15. Duct wall 14 is part of a air handling conduit 16 of an air conditioning system 17. The damper 15 and the damper shaft 12 are also part of that system.

The variable fluid pressure which controls the operation of the rotary actuator 10 derives from a source 20 of air under constant pressure feeding through an air flow restriction 22, with a fluid pressure control unit 24 bleeding air from an air pressure control conduit 26 at a variable rate responsive to the magnitude of a variable electrical signal to such fluid pressure control unit 24 as supplied on electrical signal wires 28,28.

Such an arrangement is disclosed in our co-pending patent application Ser. No. 07/024,968, filed Mar. 12, 1987.

Rotary actuator 10 includes a housing 30 made up of a bell-shape end member 32 and a main body member 34. Body member 34 includes a bifurcated portion 35. This housing 30 may be made of any of many different materials, but a combination of glass and nylon has been found to be particularly satisfactory.

A flexible diaphragm 38 includes an outer bed 39 which is sealed between end member 32 and body member 34, these members of the housing 30 being fixedly positioned with respect to each other by any usual or preferred means, such, for example, as snapping them together with the diaphragm positioned as seen in FIG. 5. This diaphragm divides the housing 30 into a fluid-tight first compartment 42 and a second compartment 44 which is open to the atmosphere as at 45.

A fluid pressure receiving port 48 is provided through the bell-shape end member 32 into the fluid-tight first compartment 42. This port opens to the air pressure control conduit 26. A piston 50 and a piston rod 52 are slidably mounted in the main body member 34 of the housing 30. The piston is in operable contact with the diaphragm 38 in the second open compartment 44 of the housing 30. The diaphragm, piston and piston rod are movable between a first position as seen in FIG. 4 wherein the fluid-tight first compartment has a minimum volume and a second position wherein the piston rod 52 will have position immediately adjacent the left end of the main body member 34 as seen in FIG. 4 and the first compartment will have a maximum volume. Air pressure exerted through air pressure control conduit 26 will tend to move the diaphragm, piston and piston rod toward their second positions.

An adjustable piston rod travel limit cap screw 53 is threadably mounted in body member 34 to provide a means for limiting exactly the outward movement of rod, thus to precisely position the angle of the damper when the diaphragm, piston and rod are in their second position.

Bias means in the form of a compression coil spring 54, operating on an intermediate wall 56 of the main body member 34 and on the piston 50 will tend to move the diaphragm, piston and piston rod toward their first positions against the action of the pressure in the first compartment.

As seen in FIG. 4, the piston rod 52 is provided with a rack 58. A piston rod support wheel 78 is rotatably mounted in housing 30 and lies in supporting contact with the pison rod. A crank arm 60 includes a collar 61 which is integral with a gear segment 62. The gear segment is in operative meshing relationship with the rack 58. Openings 64 are provided through the bifurcated portion 35 of the main body 34 and through the crank arm 60 to receive the damper/actuator shaft 12.

To install the rotary actuator, a first shaft adapter 63 is slid onto the shaft 12. Then the actuator 10 is held so that the openings 64 are in alignment with the damper shaft 12, and the actuator is slid onto the damper shaft so that this shaft passes through the openings 64 and extends out the other side of the body member 34 of the housing 30. A second shaft adapter 65 is slid onto the outer end of shaft 12. Each shaft adapter is provided with a pair of bosses 59,59, and these adapters are installed on shaft 12 so that the bosses extend toward the crank arm collar 61. This collar 61 is provided with openings 74,74 in each end thereof to snugly receive bosses 59,59. With these parts positioned as seen in FIG. 4, set screws 76,76, provided in each of the shaft adapters 64 and 65, are used to make the shaft 12 integral with crank arm 60.

This fastening of the shaft 12 and crank arm 60 to each other will be done when the damper blade 15 in its proper position for operation with the fluid-tight first compartment 42 having its minimum volume.

A pair of positioning fingers 66,66 extend axially from the housing end member 32. The installation is completed by clipping one of these fingers 66 to have fixed position with respect to the base or duct wall 14. This is accomplished by encompassing the finger 66 in one of several provided slots 68 in a right angle clip 70, and by fastening that clip 70 with respect to the duct wall 14 using sheet metal screws 72,72.

Figure 2:
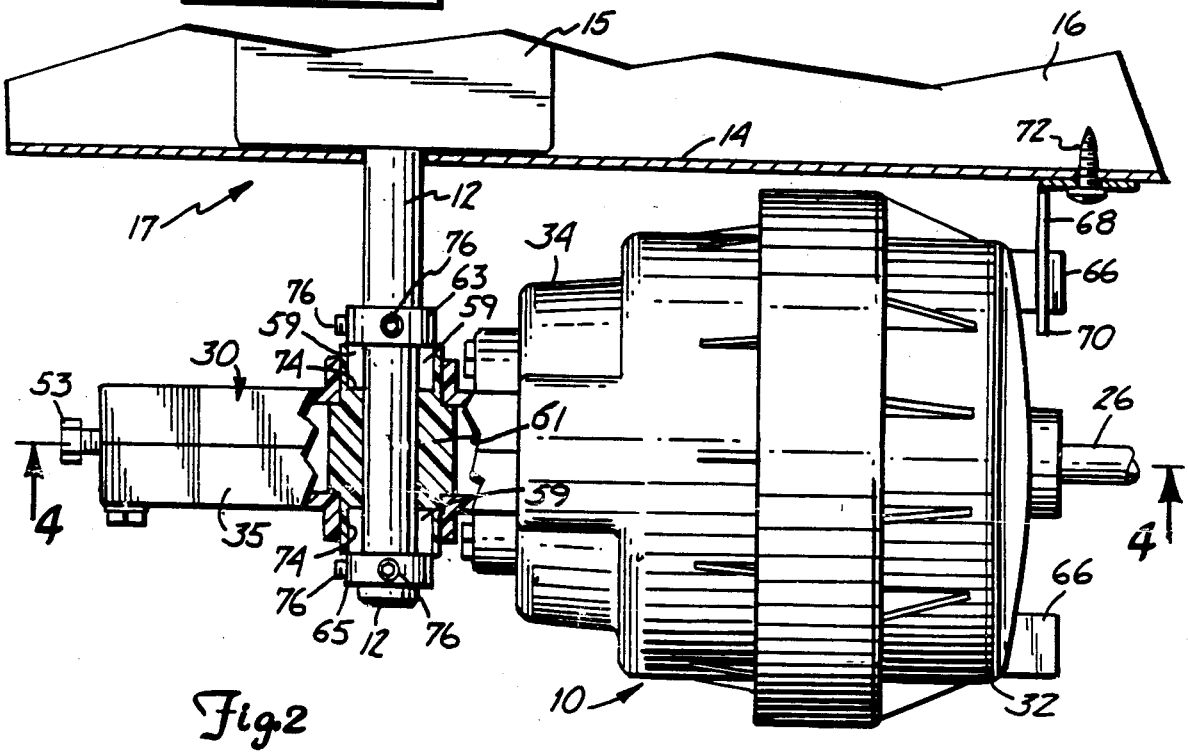
FIG. 2 is a top plan view with parts in section and parts broken away of the actuator of FIG. 1 shown installed on a damper shaft extending through a duct wall of an air conditioning system, the actuator being clipped to that wall to eliminate any rotation of the actuator about the axis of the damper shaft.

As best seen in FIG. 2, the rotary actuator 10 is supported primarily on the damper shaft 12, and has no contact with the base 14 other than the loose contact afforded by the clip 70 so that the alignment of the damper shaft 12 with the gear segment 64 and the piston rod 52 will never be disturbed.

Although the present invention has been described with reference to preferred embodiments, workers skilled in the art will recognize that changes may be made in form and detail without departing from the spirit and scope of the invention.

What is claimed is:

1. A fluid pressure to mechanical transducer for controlling the angular position of an actuator shaft rotatably mounted with respect to a base as a function of variations in fluid pressure in the transducer, said transducer including:

(a) a housing;

(b) a diaphragm within the housing separating the housing into a fluid-tight first compartment and a second compartment open to ambient pressures;

(c) the housing being provided with a fluid pressure receiving port open to said fluid-tight first compartment from a control source of variable pressure;

(d) a piston and piston rod slidably mounted within the second comparment of the housing with the piston being in operative contact with the diaphragm;

(e) said diaphragm, piston and piston rod being movable between a first position wherein said first comparment of the housing has a minimum volume and a second position wherein the first compartment has a maximum volume;

(f) bias means within the housing operative to tend to move the diaphragm, piston and rod toward their first positions against the action of fluid pressure in the first compartment tending to move these parts toward their second positions;

(g) said piston rod including a longitudinally extending rack;

(h) a crank arm rotatably mounted on a first axis within the second compartment of the housing, said crank arm including a gear segment concentric with the crank arm first axis and in operative, meshing engagement with the piston rod rack;

(i) said housing and crank arm being provided with openings therein to receive the actuator shaft, said openings being concentric with the first axis of rotation of the crank arm;

(j) first means to key the actuator shaft to rotate with the crank arm on its first axis when the actuator shaft is installed in the crank arm within the housing;

(k) second means including said crank arm and said first means for supporting said transducer on the actuator shaft; and (l) third means for fixing the position of the transducer housing with respect to the base to limit rotary movement of the transducer housing on the first axis, said third means including a prositioning finger extending integrally outwardly from the housing in spaced relation to the first axis of rotation of the crank arm and the actuator shaft, and a positioning clip fixedly mounted with respect to the base and in encompassing relationship with respect to the positioning finger.

2. A rotary actuator for a damper operably associated with a damper shaft rotatably mounted with respect to a base wall, said rotary acuator being operable to control the angular position of the actuator shaft with respect to the base wall as a function of the variations in fluid pressure inside of the rotary actuator, said rotary actuator including:

(a) a housing;

(b) a diaphragm within the housing separating the housing into a fluid-tight first compartment and a second compartment open to the atmosphere;

(c) the housing being provided with a fluid pressure receiving port open to said fluid-tight first compartment from a control source of variable pressure;

(d) a piston and piston rod slidably mounted within the second compartment of the housing with the piston being in operative contact with the diaphragm;

(e) said diaphragm, piston and piston rod being movable between a first position wherein said first compatment of the housing has a minimum volume and a second position wherein the first compartment has a maximum volume;

(f) resilient means within the housing operative to tend to move the diaphragm, piston and piston rod toward their first positions against the action of fluid pressure in the first compartment tending to move these parts toward their second positions;

(g) said piston rod including a longitudinally extending rack;

(h) a crank arm rotatably mounted in the housing on a first axis within the second compartment, said crank arm including a gear segment concentric with the crank arm first axis and being in operative, meshing engagement with the piston rod rack;

(i) said housing and crank arm being provided with openings therethrough to receive the actuator shaft, said openings being concentric with the first axis of rotation of the crank arm;

(j) first means to key the actuator shaft to rotate with the crank arm on its first axis when the actuator shaft is installed in the crank arm within the housing;

(k) second means including said crank arm and said first means for supporting and maintaining said transducer on the actuator shaft; and (l) third means for fixing the position of the rotary actuator housing with respect to the base wall to limit rotary movement of the housing on said first axis, said third means including a positioning finger extending intergrally outwardly from the housing in spaced relation to the first axis of rotation of the crank arm and the actuator shaft, and a positioning clip fixedly mounted with respect to the base wall and in encompassing relationship with respect to the positioning finger.

3. The rotary actuator of claim 2 wherein:

(m) said resilient means includes a compression coil spring operative on a portion of the housing in the second compartment and on the piston.

4. The rotary actuator of claim 2 wherein:

(n) the crank arm includes a collar in integral supporting relationship to the gear segment, said collar being rotatably mounted in the second compartment of the rotary actuator housing on said first axis, and being provided with an opening therethrough to snugly receive the actuator shaft.

5. The rotary actuator of claim 2 wherein:

(m) a piston rod support wheel is rotatably mounted with respect to the housing in contact with the piston rod in position immediately opposite that portion of the piston rod rack which is in contact with the gear segment.

6. The rotary actuator of claim 2 wherein:

(m) an adjustable stop is provided in the housing in axial alignment with the piston rod in position to precisely limit the movement of the piston rod and crank arm so to precisely determine the angular position of the actuator shaft as the parts associated with the piston rod move toward their second position.

7. The rotary actuator of claim 6 wherein:

(n) the adjustable stop is in the form of a cap screw threadably mounted in the housing in linear alignment with the longitudinal axis of movement of the piston rod and in position to be in interfering relationship with movement of the piston rod.

8. A rotary actuator for a damper operably associated with a damper shaft rotatably mounted with respect to a base wall, said rotary actuator being operable to control the angular position of the actuator shaft with respect to the base wall as a function of the variations in fluid pressure inside of the rotary actuator, said rotary actuator including:

(a) a housing;

(b) a diphragm within the housing separating the housing into a fluid-tight first compartment and a second compartment open to the atmosphere;

(c) the housing being provided with a fluid pressure receiving port open to said fluid-tight first compartment from a control source of variable pressure;

(d) a piston and piston rod slidably mounted within the second compartment of the housing with the piston being in operative contact with the diaphragm;

(e) said diaphragm, piston and piston rod being movable between a first position wherein said first compartment of the housing has a minimum volume and a second position wherein the first compartment has a maximum volume;

(f) resilient means within the housing operative to tend to move the diaphragm, piston and piston rod toward their first positions against the action of fluid pressure in the first compartment tending to move these parts toward their second positions;

(g) said piston rod including a longitudinally extending rack;

(h) a crank arm rotatably mounted in the housing on a first axis within the second compartment, said crank arm including a gear segment concentric with the crank arm first axis and being in operative, meshing engagement with the piston rod rack;

(i) said housing and crank arm being provided with openings therethrough to receive the actuator shaft, said openings being concentric with the first axis of rotation of the crank arm;

(j) first means to key the actuator shaft to rotate with the crank arm on its first axis when the actuator shaft is installed in the crank arm within the housing;

(k) second means including said crank arm and said first means for supporting and maintaining said transducer on the actuator shaft;

(l) third means for fixing the position of the rotary actuator housing with respect to the base wall to limit rotary movement of the actuator housing on said first axis;

(n) wherein the crank arm includes a collar in integral supporting relationship to the gear segment, said collar being rotatably mounted in the second compartment of the rotary actuator housing on said first axis, and being provided with an opening therethrough to snugly receive the actuator shaft; and (o) wherein the first means to key the actuator shaft to rotate with the crank arm includes at least one opening in the crank arm collar in axial alignment with the first axis, and at least one shaft adapter fixedly attached to the actuator shaft to rotate with it and having at least one boss extending from it into said opening in the crank arm collar.

9. The rotary actuator of claim 8 wherein:

(p) fourth means is provided to limit axial movement of the rotary actuator longitudinally along the first axis of the actuator shaft, said means including said shaft adapter on a first side of the housing and a second collar-like member mounted on the shaft on a second side of the housing.

* * * * *

UNITED STATES PATENT AND TRADEMARK OFFICE

CERTIFICATE OF CORRECTION

PATENT NO. : 4,794,847

DATED : January 3, 1989

INVENTOR(S) : Paul E. Kreuter, Larry G. Odegaard

It is certified that error appears in the above-identified patent and that said Letters Patent is hereby corrected as shown below:

Column 4, line 64, delete "comparment", and insert "compartment";

Column 5, line 30, delete "prositioning" and insert "positioning";

Column 5, Lines 57-58, delete "compatment" and insert "compartment";

Column 6, line 66, delete "diphragm" and insert "diaphragm".

Signed and Sealed this

Thirtieth Day of May, 1989

*Attest:*

DONALD J. QUIGG

*Attesting Officer*

*Commissioner of Patents and Trademarks*